US007540771B2

(12) United States Patent
Lee et al.

(10) Patent No.: US 7,540,771 B2
(45) Date of Patent: Jun. 2, 2009

(54) RIGHT ANGLE COAXIAL CONNECTOR MOUNTABLE ON PCB

(75) Inventors: Hai-Young Lee, Gyeonggi-do (KR); Yong-Goo Lee, Seoul (KR); Kyoung-Il Kang, Gyeongsangnam-do (KR)

(73) Assignee: Gigalane Co., Ltd, Gyeonggi-Do (KR)

( * ) Notice: Subject to any disclaimer, the term of this patent is extended or adjusted under 35 U.S.C. 154(b) by 0 days.

(21) Appl. No.: 11/571,889

(22) PCT Filed: Jul. 10, 2004

(86) PCT No.: PCT/KR2004/001703

§ 371 (c)(1),
(2), (4) Date: Jan. 18, 2007

(87) PCT Pub. No.: WO2006/006747

PCT Pub. Date: Jan. 19, 2006

(65) Prior Publication Data

US 2008/0045043 A1 Feb. 21, 2008

(51) Int. Cl.
*H01R 9/05* (2006.01)

(52) U.S. Cl. ..... 439/581; 439/63

(58) Field of Classification Search ..... 439/63, 439/581

See application file for complete search history.

(56) References Cited

U.S. PATENT DOCUMENTS 4,964,805 A * 10/1990 Gabany ..... 439/63
5,062,811 A * 11/1991 Hackman ..... 439/620.03
5,645,454 A * 7/1997 Kosmala ..... 439/675
5,897,384 A * 4/1999 Hosler, Sr. ..... 439/63
5,921,793 A * 7/1999 Phillips ..... 439/188
6,065,976 A * 5/2000 Wang ..... 439/63
6,164,977 A * 12/2000 Lester ..... 439/63
6,305,947 B1 10/2001 Bruce
6,390,825 B1 * 5/2002 Handley et al. ..... 439/63
6,719,586 B2 * 4/2004 Weidner ..... 439/581
6,776,621 B1 * 8/2004 Dye ..... 439/63
7,165,974 B2 * 1/2007 Kooiman ..... 439/63
7,186,139 B2 * 3/2007 Chen et al. ..... 439/541.5
7,270,569 B2 * 9/2007 Petersen et al. ..... 439/582
7,326,063 B1 * 2/2008 Raudenbush et al. ..... 439/63
2004/0203283 A1 * 10/2004 Chen et al. ..... 439/578

FOREIGN PATENT DOCUMENTS

KR 10-20020029053 5/2002
KR 2004-0007230 1/2004
KR 1020040007230 2/2004
KR 2004-0036021 4/2004

* cited by examiner

*Primary Examiner*—Renee Luebke
*Assistant Examiner*—Larisa Tsukerman
(74) *Attorney, Agent, or Firm*—Portland IP Law, LLC

(57) ABSTRACT

A board mount type right angle coaxial connector has a cylindrical body and a main body containing a dielectric and an air dielectric, respectively. The bodies are connected to each other at a right angle. The coaxial connector further has a conductor surrounded with the dielectric and the air dielectric. The conductor has also a right-angle structure and is protruded from a front side of the main body. An inner wall of the main body has a decreasing width and the conductor has a decreasing diameter. The coaxial connector may further has a fixing member for preventing pin rotation, a impedance matching ring, and ground supporters for mounting on the board.

5 Claims, 17 Drawing Sheets

FIG. 2A
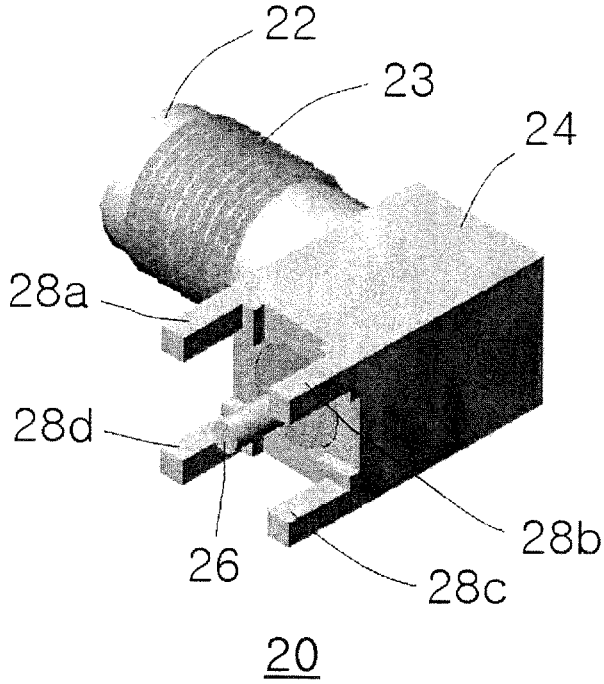
FIG. 2B
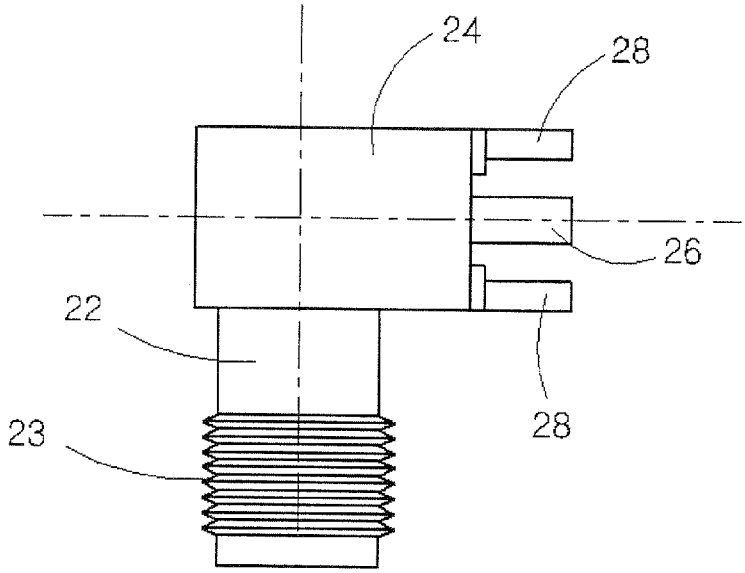
FIG. 2C

RIGHT ANGLE COAXIAL CONNECTOR MOUNTABLE ON PCB

TECHNICAL FIELD

The present invention relates to a coaxial connector and, more particularly, to a right angle coaxial connector available for a board jack.

BACKGROUND ART

The SMA (Subminiature A) connector was originally designed by Bendix Scintilla Corporation, and is one of the most commonly used RF/microwave connectors. A standard SMA connector is designed for interconnects to 12.4 GHz. Fortunately, a good SMA is useable to 18 GHz in most cables, and if well constructed with greater loss and lower return loss to 24 GHz.

Among the SMA connectors, board mount type SMA connectors mounted on a board such as PCB are typically classified into a vertical mount straight PCB jack and a right angle PCB jack. FIG. 1 shows a conventional straight SMA coaxial connector, whereas FIG. 2 shows a conventional right angle SMA coaxial connector.

Referring to FIGS. 1*a* to 1*d*, a conventional straight coaxial connector 10 includes a cylindrical body 12, a main body 14, a central conductor 16, and ground legs 18. The cylindrical body 12 has spiral threads 13 thereon, and contains a terminal 11 surrounded with a dielectric 15 therein. The terminal 11 is connected to the central conductor 16. The central conductor 16 and the ground legs 18 are protruded from the main body 14 in the counter direction of the cylindrical body 12. The ground legs 18 are composed of four legs 18*a*~18*d* disposed at four corners of the main body 14.

As shown in FIGS. 1*d* to 1*f*, this conventional coaxial connector 10 is vertically surface-mounted to a board 30, such as PCB, on which circuit patterns 32 are formed. The central conductor 16 and the ground legs 18 are inserted into through holes 36 and 38*a*~38*d*, respectively, and then joined to the board 30 by solder 35 and 37 on the rear side of the board 30.

A conventional right angle coaxial connector 20 shown in FIGS. 2*a* to 2*c* is vertically surface-mounted to the board, in the same way as the connector 10 shown in FIG. 1. However, contrary to the connector 10 in FIG. 1, a cylindrical body 22 is configured at a right angle to a main body 24. A central conductor 26 and ground legs 28 are similar in structure to those of the connector in FIG. 1. Since the above-discussed conventional connectors, shown in FIGS. 1 and 2, can be mounted to a surface as well as edges of the board, there is sufficient board space to receive the connectors. However, the straight SMA connector 10 shown in FIG. 1 may have poor electrical characteristics by increased inductance in high frequency region because the central conductor 16 is connected via the through holes 36 and 38 of the board 30. So, this type connector may be not suitable for high frequency, for example, 3 GHz or more. And also, the right angle SMA connector 20 shown in FIG. 2 may be not suitable for high frequency because the central conductor 26 is extended at a right angle to the terminal.

DISCLOSURE OF THE INVENTION

It is therefore an object of the present invention to provide a board mount type coaxial connector having excellent electrical characteristics as well as sufficient board mounting space.

Another object of the present invention is to provide a board mount type coaxial connector not only being suitable for high frequency, but also allowing good mass production and automatic process.

The present invention provides a board mount type right angle coaxial connector that comprises a cylindrical body containing a dielectric therein, and a main body containing an air dielectric therein. The main body is connected to the cylindrical body at a right angle to the cylindrical body. The coaxial connector of the present invention further comprises a terminal conductor surrounded with the dielectric, and a central conductor surrounded with the air dielectric. The central conductor is connected to the terminal conductor at a right angle to the terminal conductor, and protruded from a front side of the main body. The coaxial connector of the invention still further comprises at least one ground supporter, which is formed on the main body and configured not only to support the main body when the connector is mounted to a board, but also to provide ground planes to the connector. In particular, an inner wall of the main body has a decreasing width and the central conductor has a decreasing diameter.

The coaxial connector of the invention may further comprise a metal ring formed in close adjacent to the front side of the main body, and/or a fixing member formed in the cylindrical body to fix the terminal conductor.

In the coaxial connector of the invention, the ground supporter may include at least one wing part formed on and protruded from at least one side of the main body, and at least one tab formed on the front side of the main body and protruded from the wing part. Alternatively, the ground supporter may include at least one side protrusion formed on and protruded from at least one side of the main body, and at least one re-projecting part formed on the front side of the main body and protruded from the side protrusion.

BRIEF DESCRIPTION OF THE DRAWINGS

FIGS. 2*a* to 2*c* are a perspective view and cross-sectional views, respectively, showing a conventional right angle SMA coaxial connector.

BEST MODES FOR CARRYING OUT THE INVENTION

Exemplary, non-limiting embodiments of the present invention will now be described more fully hereinafter with reference to the accompanying drawings. This invention may, however, be embodied in many different forms and should not be construed as limited to the exemplary embodiments set forth herein. Rather, the disclosed embodiments are provided so that this disclosure will be thorough and complete, and will fully convey the scope of the invention to those skilled in the art. The principles and features of this invention may be employed in varied and numerous embodiments without departing from the scope of the invention.

In is noted that well-known structures and processes are not described or illustrated in detail to avoid obscuring the essence of the present invention. It is also noted that the figures are not drawn to scale. Rather, for simplicity and clarity of illustration, the dimensions of some of the elements are exaggerated relative to other elements.

FIRST EMBODIMENT

FIGS. 3 and 4*a* to 4*e* show, in a perspective view and cross-sectional views, a coaxial connector 100 in accordance with a first embodiment of the present invention.

Figure 1A:
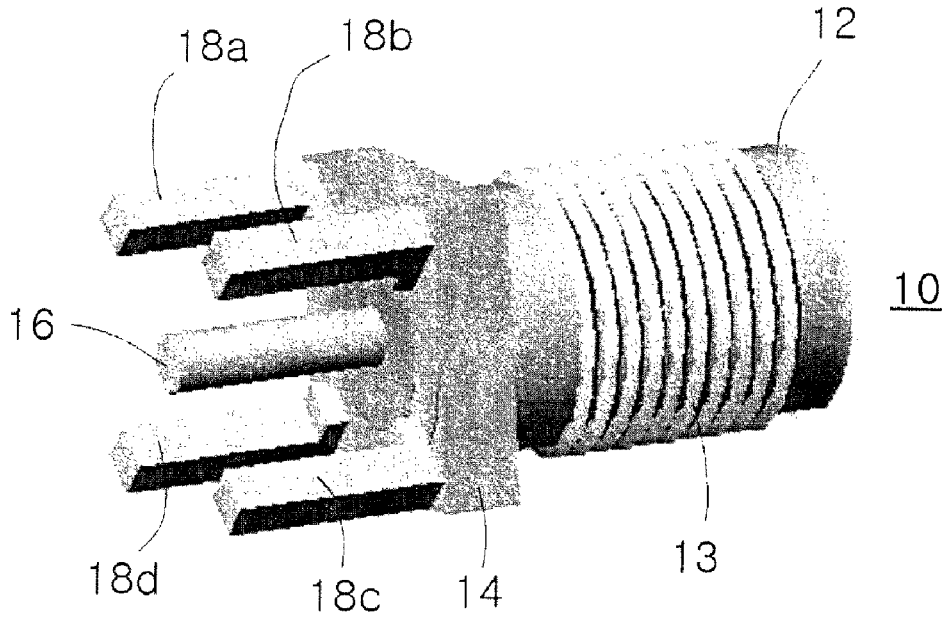
FIGS. 1*a* to 1*c* are a perspective view and cross-sectional views, respectively, showing a conventional vertical mount straight SMA coaxial connector.
Figure 1B:
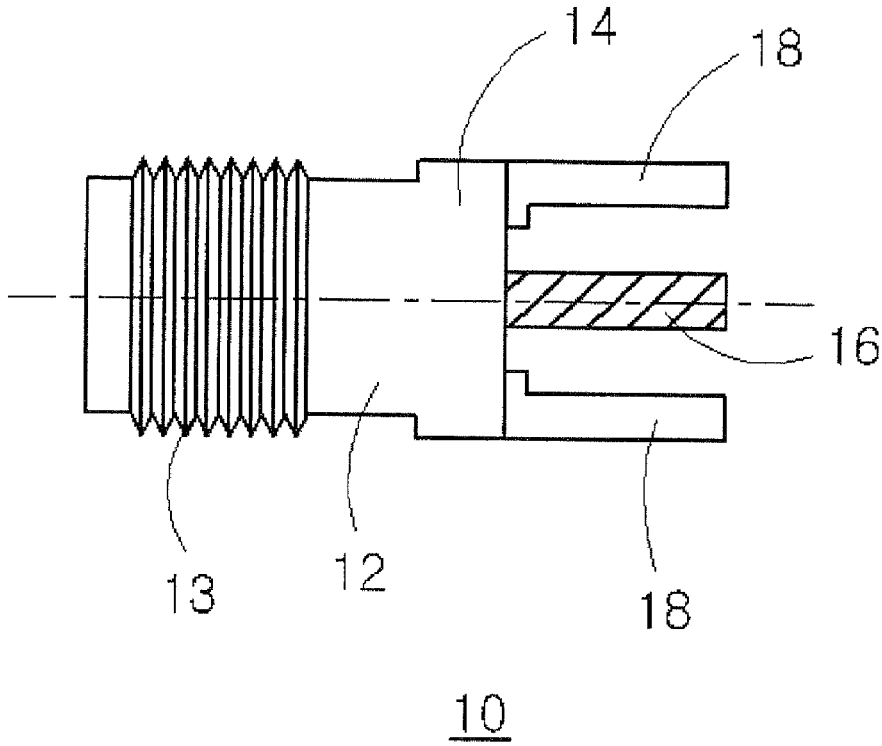
Figure 1C:
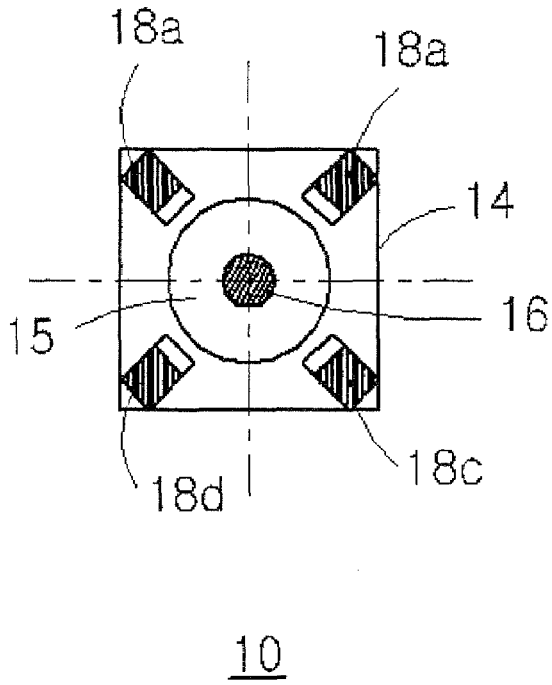
Figure 1D:
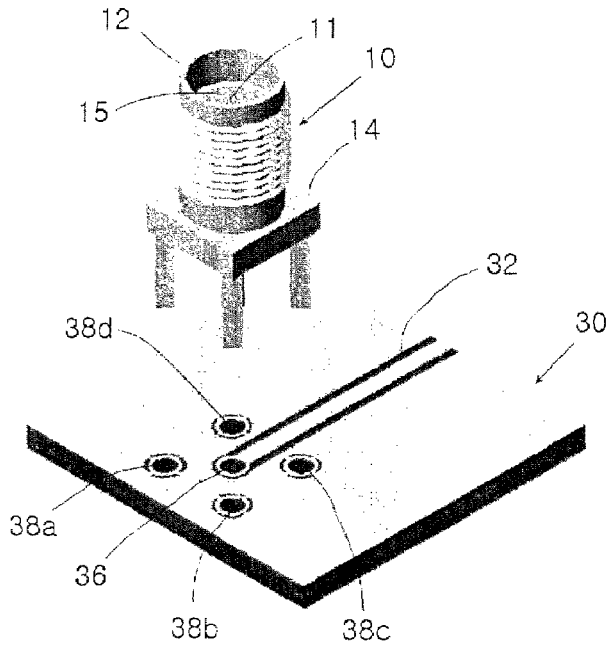
FIGS. 1*d* to 1*f* are perspective views and a cross-sectional view, respectively, showing the used state of a conventional vertical mount straight SMA coaxial connector.
Figure 1E:
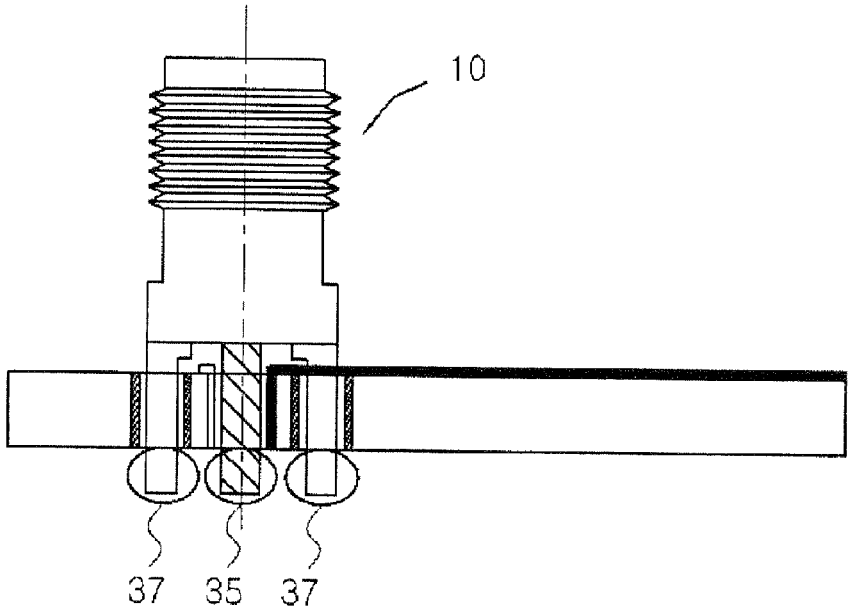
Figure 1F:
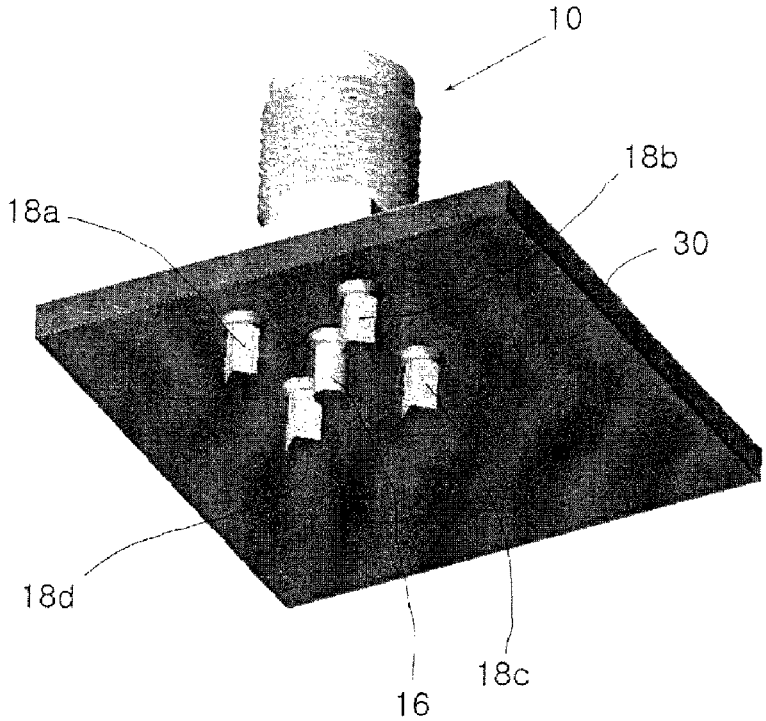
Figure 2C:
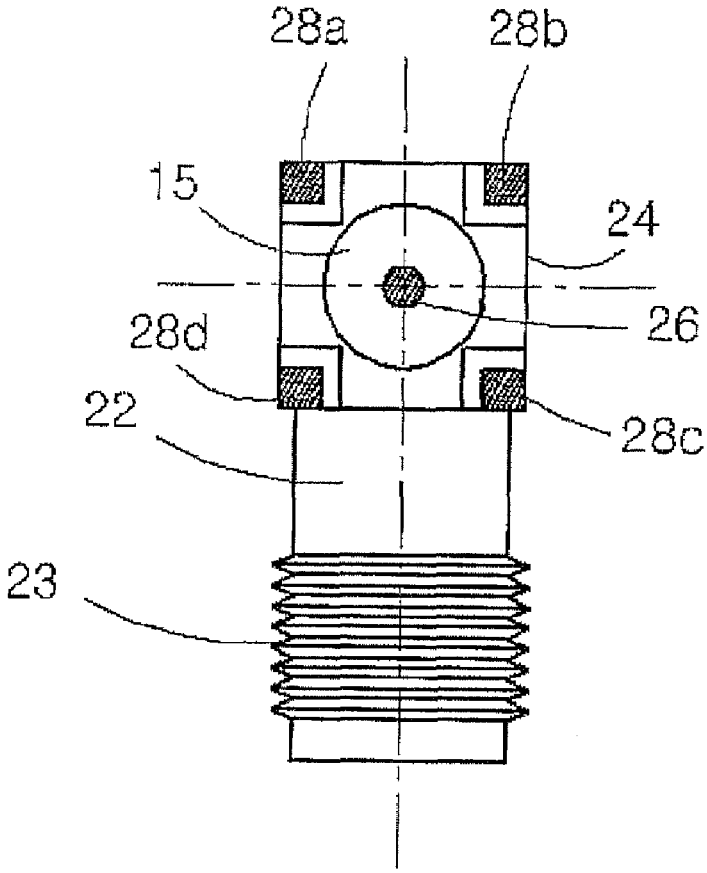
Figure 3:
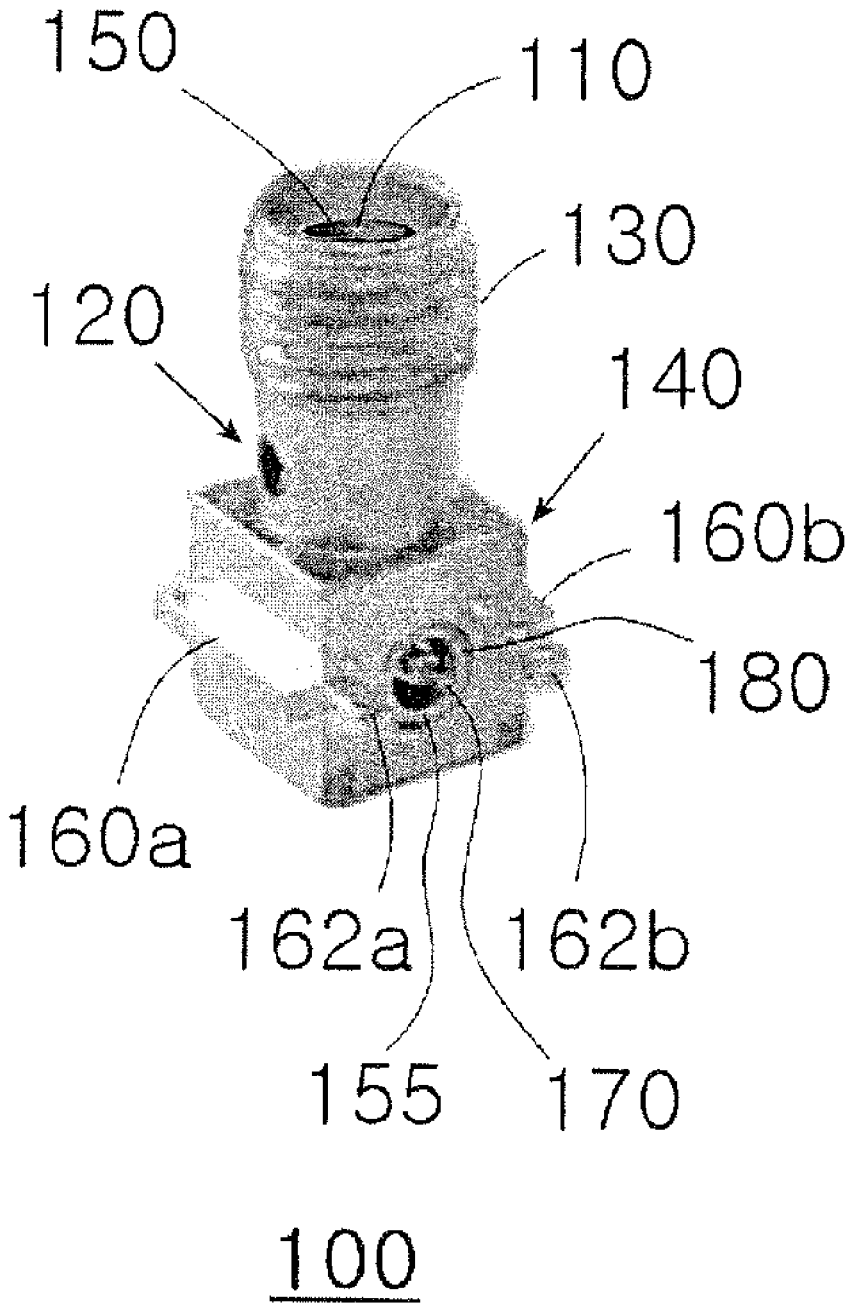
FIG. 3 is a perspective view of a coaxial connector in accordance with a first embodiment of the present invention.
Figure 4A:
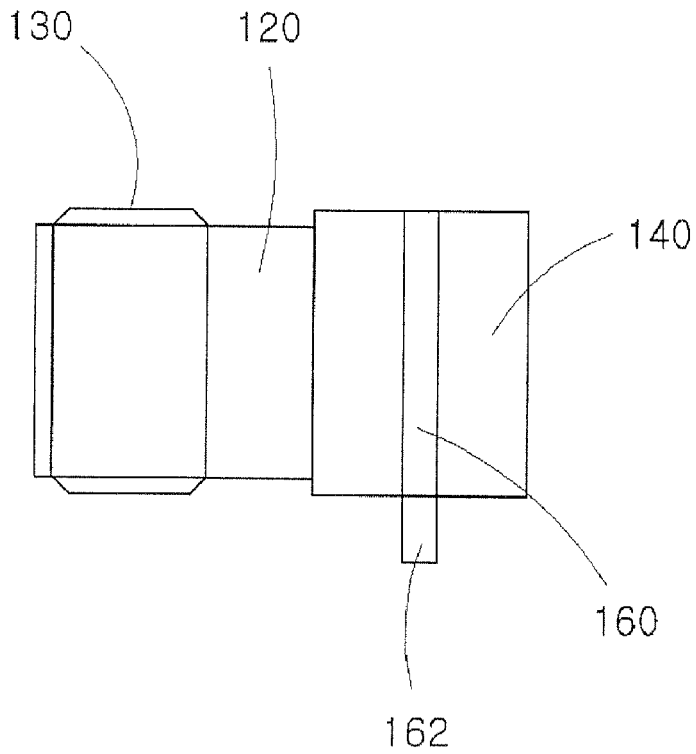
FIGS. 4*a* to 4*e* are cross-sectional views of the coaxial connector in accordance with the first embodiment of the present invention.
Figure 4B:
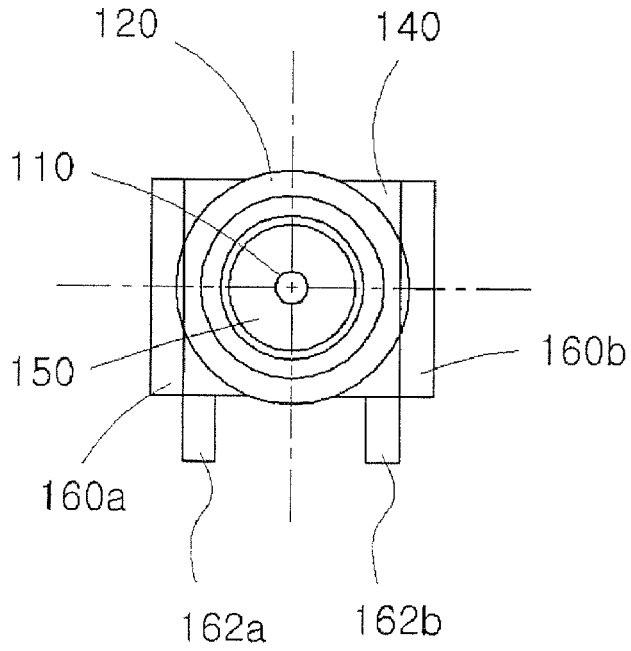
Figure 4C:
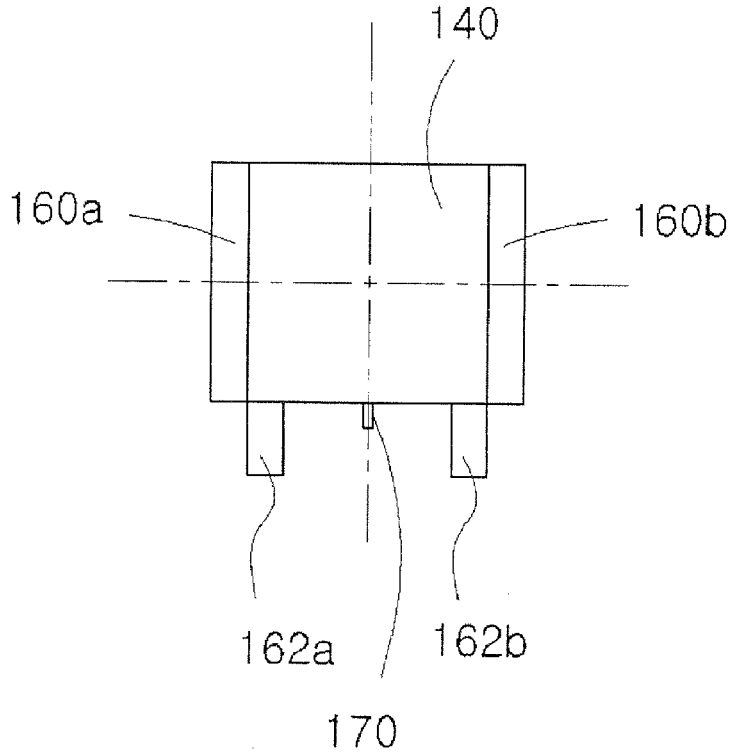
Figure 4D:
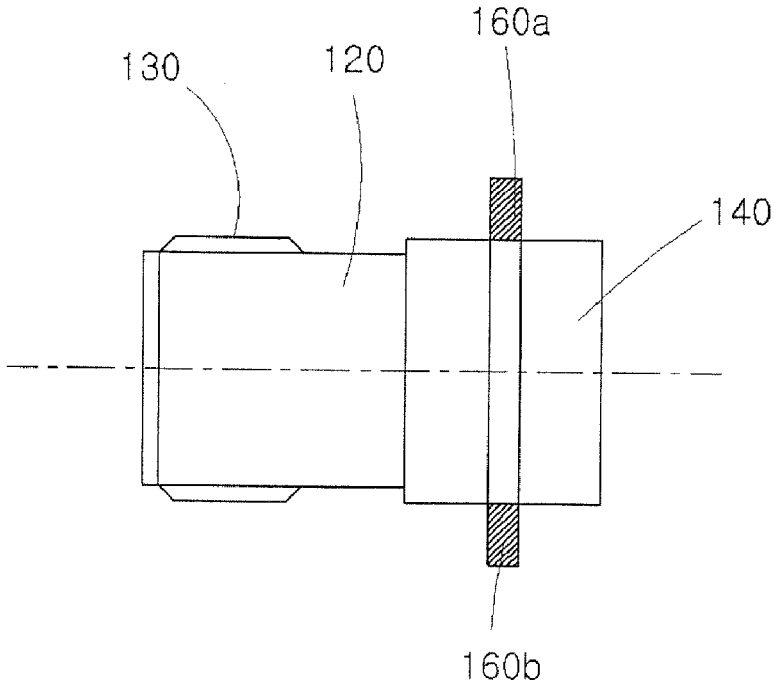
Figure 4E:
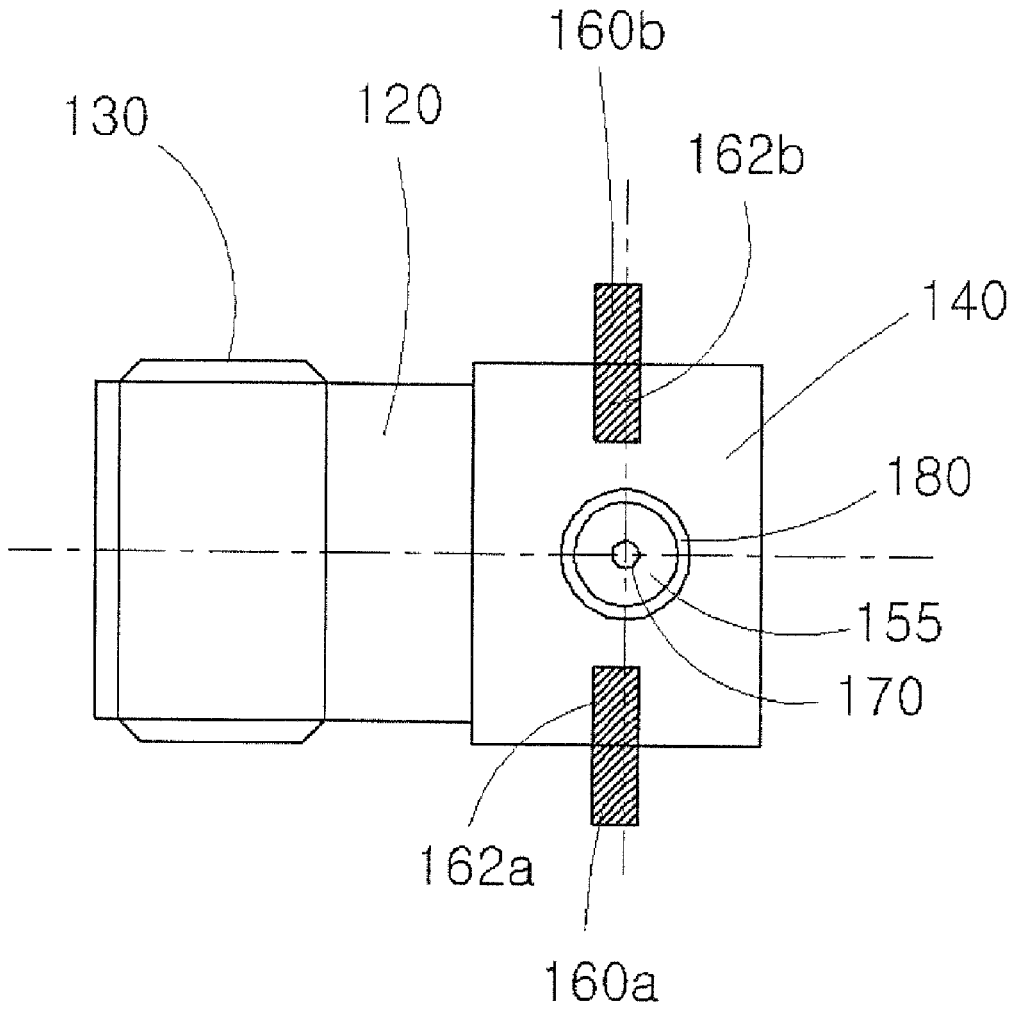

Referring to FIGS. 3 and 4, the coaxial connector 100 includes a cylindrical body 120 and a main body 140. On the cylindrical body 120, a fastening member 130 such as spiral threads is formed. In the cylindrical body 120, a terminal conductor 110 surrounded with a dielectric 150 is extended in a straight line. The cylindrical body 120 is connected to the main body 140. A part of the inside of the main body 140 is configured at a right angle to the cylindrical body 120. Two wing parts 160*a* and 160*b* are formed on both sides of the main body 140, being configured to have the same structure. Each wing part 160*a*, 160*b* is vertically protruded from the main body 140 and horizontally extended along the center of the main body 140. The horizontal length of the wing part is equal to that of the main body 140. A terminal 170 (also referred to as a central conductor or a pin) is formed on and somewhat protruded from the front side of the main body 140 as shown in FIG. 4*c*. Additionally, two tabs 162*a* and 162*b* are formed in the shape of short legs on the front side of the main body 140, corresponding to the wing parts 160*a* and 160*b*, respectively.

As will be described later, the wing parts 160*a*, 160*b* and the tabs 162*a*, 162*b* not only support the coaxial connector 100 when the connector 100 is mounted to the board, but also provide ground planes to the connector 100. So, the wing parts and the tabs may be referred to as ground supporters. While the wing parts 160*a* and 160*b* support both sides of the connector 100, the tabs 162*a* and 162*b* support front and rear sides of the connector 100. In order to reduce return current, it is desirable to dispose the tabs 162*a* and 162*b* in the vicinity of board circuit patterns electrically coupled to the central conductor 170 (that is, near ground conductors of the coaxial connector).

Figure 5:
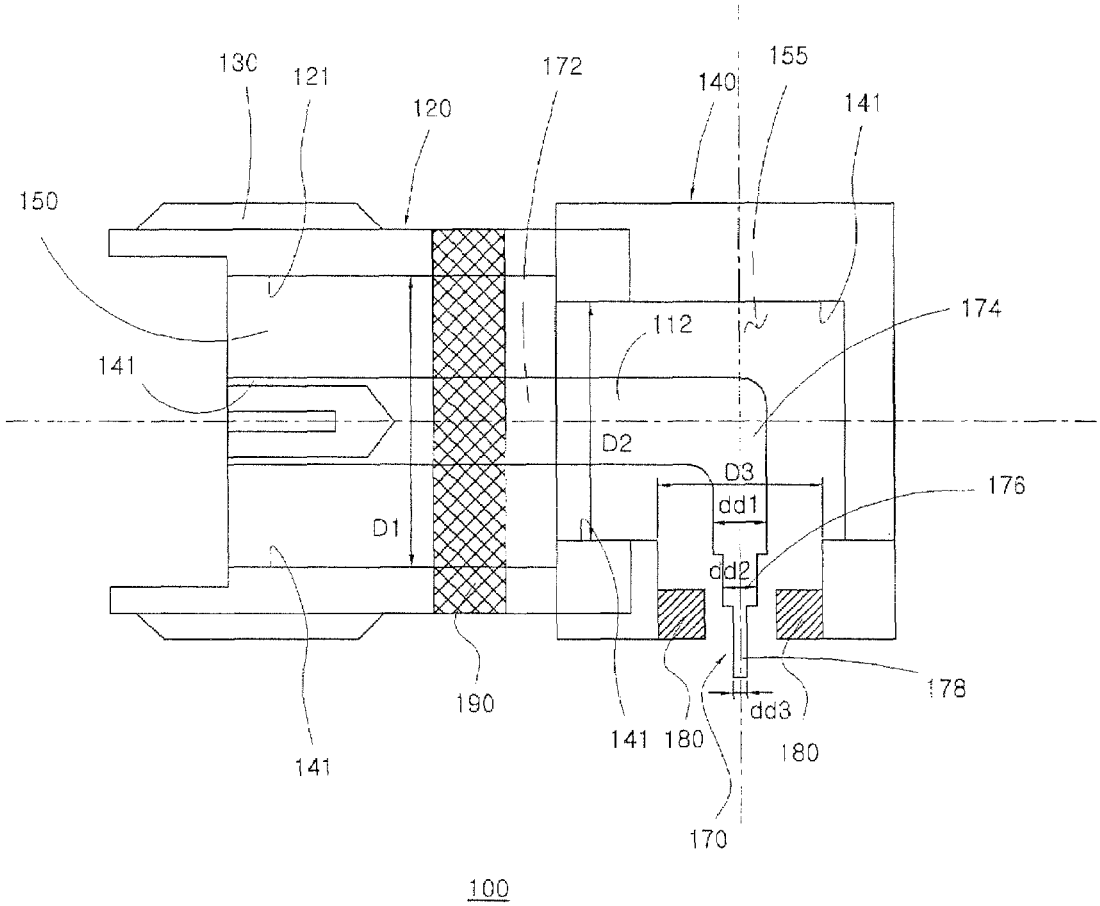
FIG. 5 is an enlarged cross-sectional view showing an internal structure of a coaxial connector in accordance with the present invention.

An internal structure of the coaxial connector of the first embodiment is shown in FIG. 5. The internal structure in FIG. 5 is the same as in a second embodiment which will be discussed later. That is, the internal structure shown in FIG. 5 is applied to all the coaxial connectors according to the present invention.

Referring to FIG. 5, an inner wall 121 of the cylindrical body 120 has a straight cross section. Therefore, the dielectric 150 in the cylindrical body 120 has a uniform diameter D1. Contrary to that, an inner wall 141 of the main body 140 has a right-angle structure and non-uniform (i.e., decreasing) width. Therefore, an air dielectric 155 in the main body 140 has a decreasing diameter from D2 to D3. Similarly, the central conductor 170 has a right-angle structure and a decreasing diameter. That is, a first part 172 of the central conductor located in the cylindrical body 120 has the same diameter dd1 as a second part 174 directly extended from the first part 172, located in the main body 140 and perpendicularly bent. A third part 176 extended from the second part 174 has a diameter dd2 smaller than the diameter dd1 of the second part 174. And a fourth part 178 extended from the third part 176 and protruded from the main body 140 has the smallest diameter dd3.

The dielectric 150 in the cylindrical body 120 is formed of dielectric substance except air, for example, with a dielectric constant between 2 and 5. On the other hand, the main body 140 contains the air dielectric 155 therein.

In the cylindrical body 120, a fixing member 190 is formed to fix the first part 172 and thereby to prevent the rotation of the central conductor 170. The fixing member 190 may be made of epoxy. After the dielectric 150 is inserted into the cylindrical body 120, a hole for the first part 172 is made in the dielectric 150 with a drill. The central conductor 170 is inserted into the hole, and epoxy is injected therein and then cured. As a result, the cured epoxy supports the central conductor 170 and the dielectric 150. If the central conductor 170 is rotated, it is difficult to keep a balance during a soldering process on the board. This may further cause a drop in electrical characteristics. Besides, when a male connector (not shown) is joined, the male connector pushes the central conductor 170 of the coaxial connector. The fixing member 190 may also prevent the central conductor 170 from being pushed.

Around the fourth part 178, namely, in close adjacent to the front side of the main body 140, a ring 180 is formed of metal for impedance matching and plated with gold, for example. The ring 180 compensates variations in impedance caused by decreasing diameter (dd1→dd2→dd3) of the central conductor. The inner wall 141 of the main body 140 is mechanically processed to reduce step by step the inside diameter of the main body 140. However, since the end of the inner wall 141 surrounding the fourth part 178 is difficult to process, it is desirable to use the metal ring 180 to obtain diameter-reducing effect.

As discussed above, the inside of the coaxial connector of the invention has the following structural features. The followings are only provided for the purpose of a full understanding of the invention, not for the purpose of limiting the invention. Accordingly, the scope of the invention will be defined by structures claimed in appended claims and their equivalents.

Figure 6A:
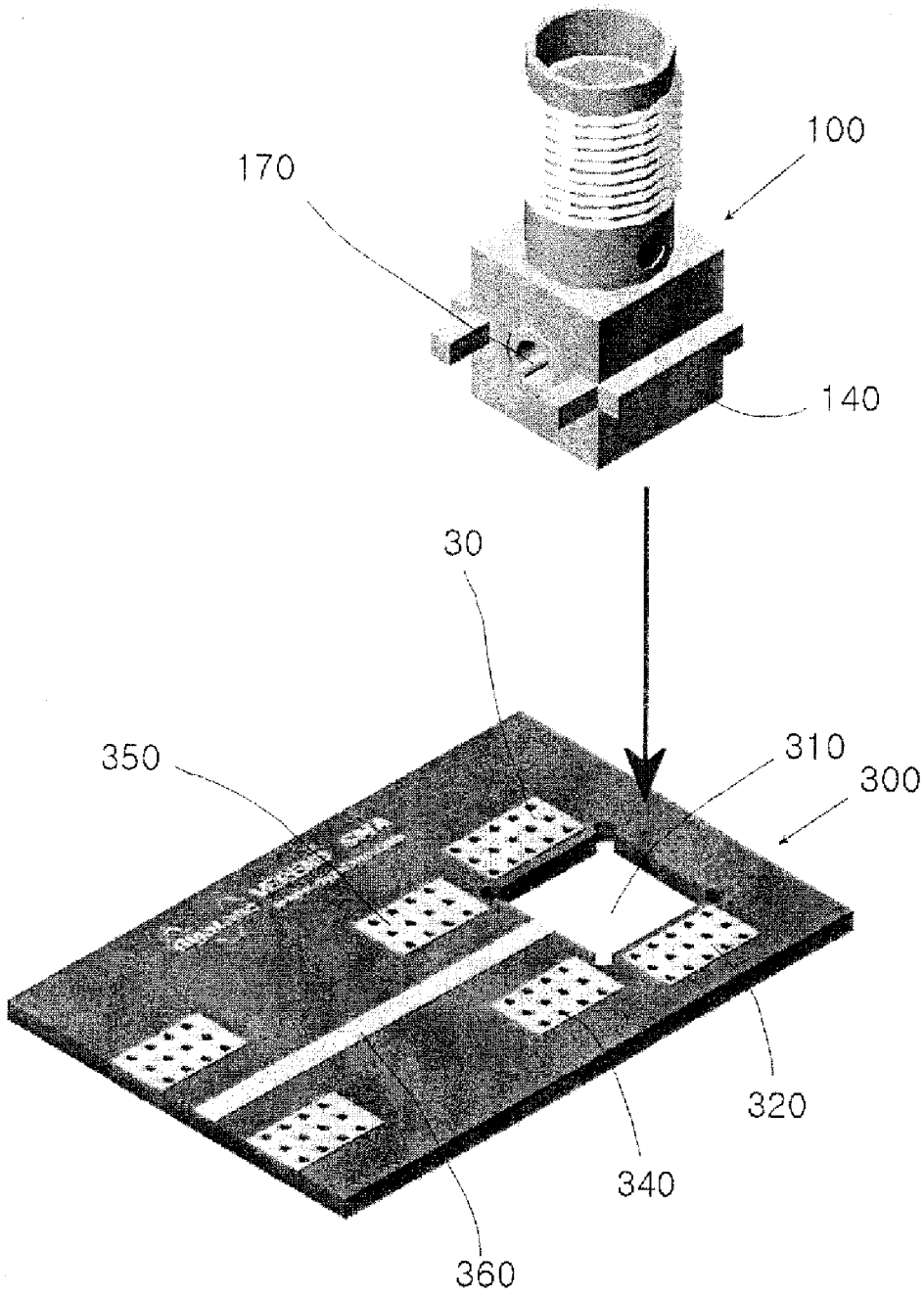
FIGS. 6*a* and 6*b* are perspective views showing a structure that the coaxial connector of the first embodiment is mounted on a board.
Figure 6B:
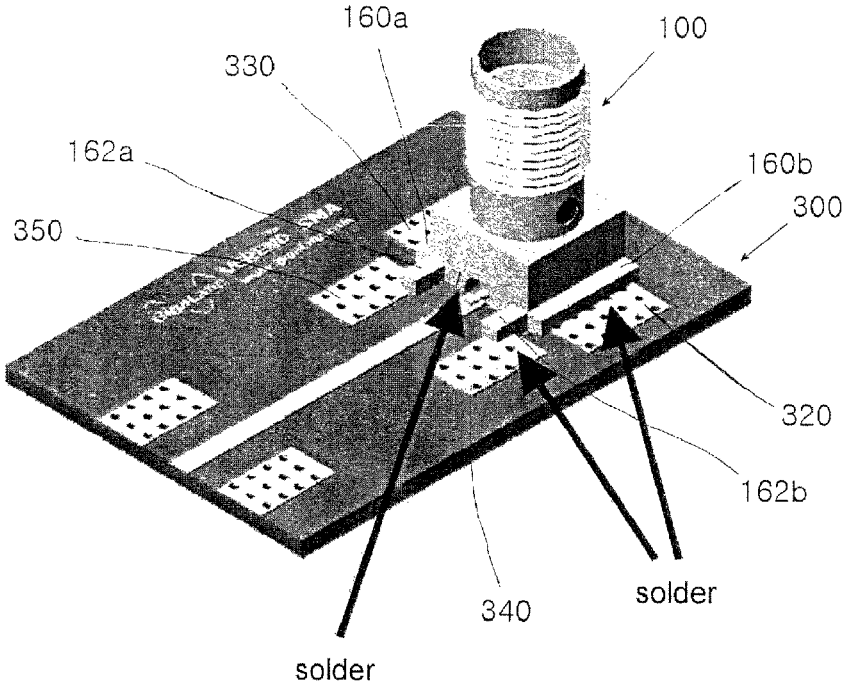
Figure 6C:
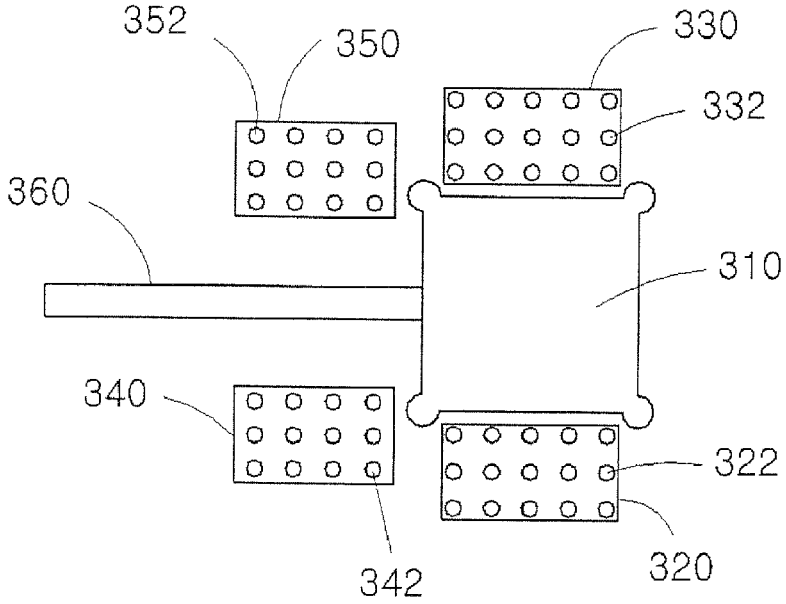
FIG. 6*c* is a pattern diagram of a board suitable for mounting of the coaxial connector of the present invention.

- the right angle coaxial connector having 90 degrees bending structure
- variations in diameter of the central conductor and the dielectric
- air dielectric surrounding parts of the central conductor
- the fixing member preventing pin rotation
- impedance matching ring FIGS. 6*a* and 6*b* show, in perspective views, a structure that the coaxial connector of the first embodiment is mounted on a board. And FIG. 6*c* is a pattern diagram of a board suitable for mounting of the coaxial connector of the present invention.

As shown in FIGS. 6*a* and 6*b*, a PCB board 300 has a through hole 310 for receiving the coaxial connector 100 of the invention. The PCB board 300 further has land patterns 320, 330, 340 and 350 and circuit patterns 360. As shown in FIG. 6*c*, each land pattern has plural via holes 322~352 formed therein. These via holes 322~352 electrically couple the land patterns 320~350 on a top side of the board to a ground plane on a bottom side of the board.

Referring again to FIG. 6*a*, the coaxial connector 100 is mounted to the board 300 by inserting the main body 140 into the through hole 310. At this time, as shown in FIG. 6*b*, the wing parts 160*a*, 160*b* and the tabs 162*a*, 162*b* are surface-contacted with the land patterns 320, 330, 340 and 350, respectively. Therefore, only lower portions under the wing parts 160*a*, 160*b* of the main body 140 are located in the through hole 310, and the rest portions are located above the board 300. The wing parts 160*a*, 160*b* and the tabs 162*a*, 162*b* are joined by soldering to the respective land patterns 320, 330, 340 and 350. Further, the central conductor 170 of the connector 100 is joined by soldering to the circuit patterns 360.

SECOND EMBODIMENT

Figure 7A:
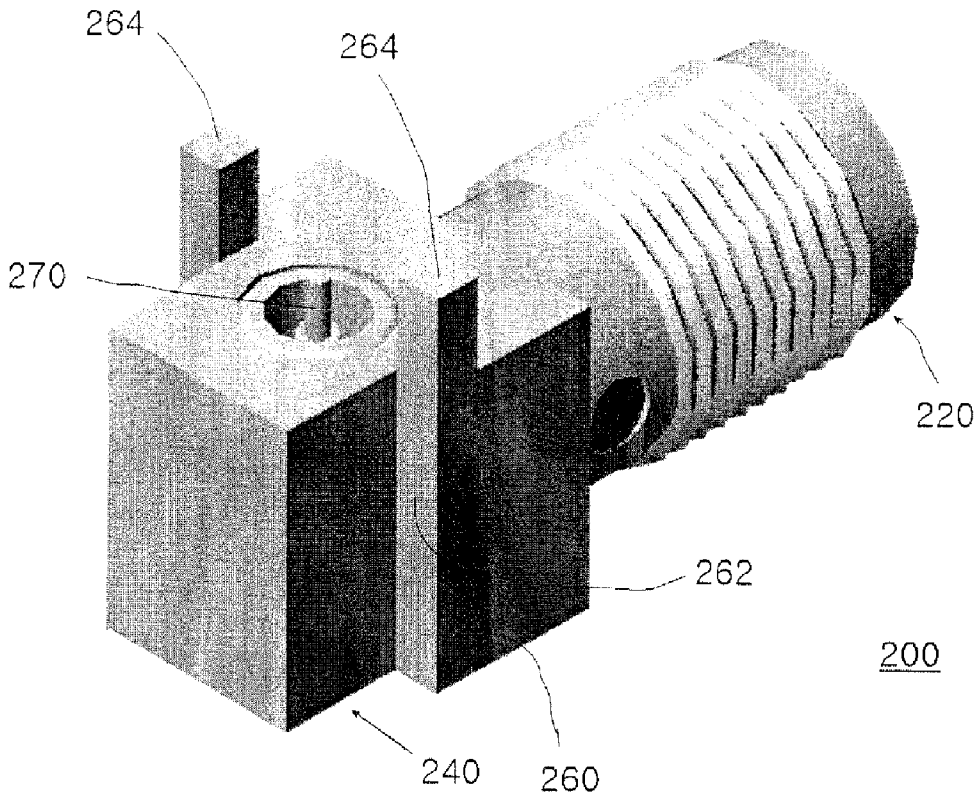
FIGS. 7*a* and 7*b* are perspective views of a coaxial connector in accordance with a second embodiment of the present invention.
Figure 7B:
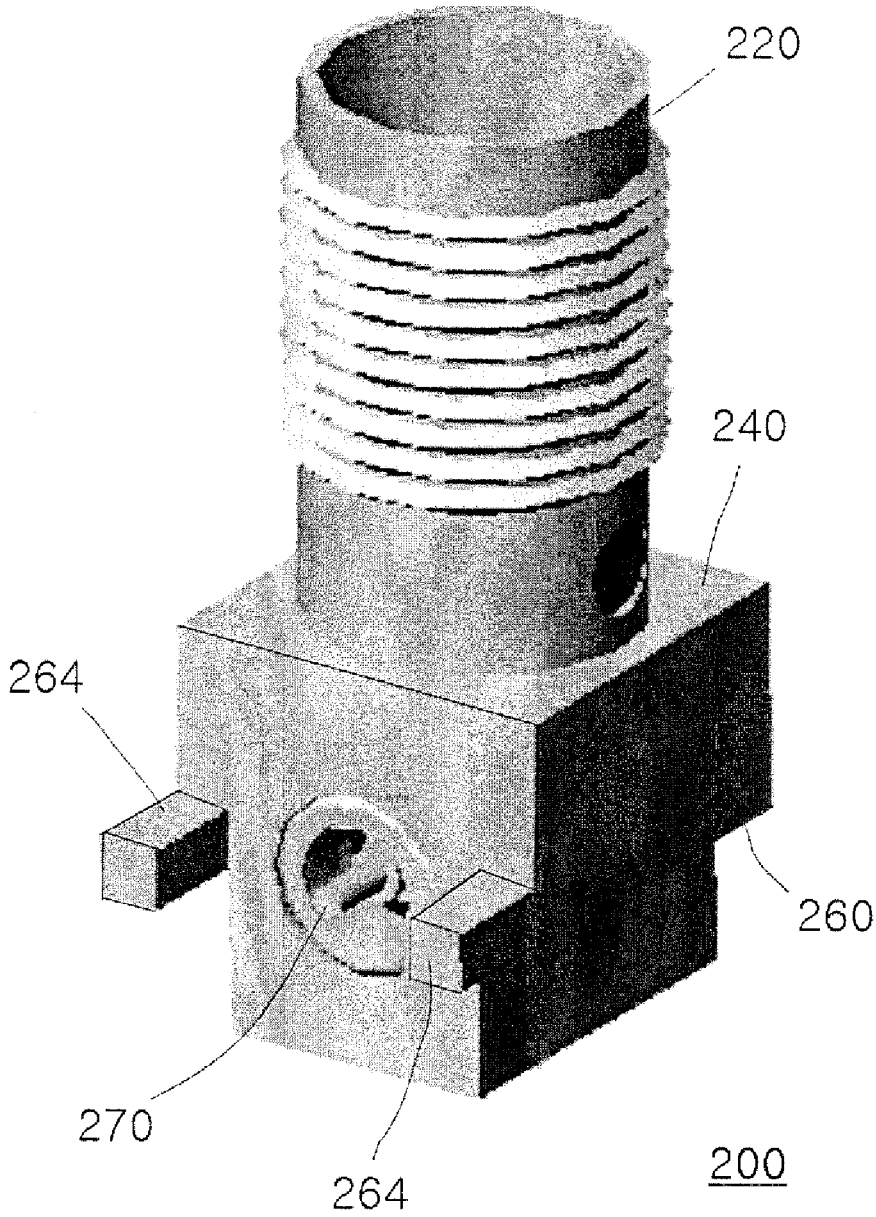

FIGS. 7*a* and 7*b* are perspective views of a coaxial connector 200 in accordance with a second embodiment of the present invention.

The coaxial connector 200 of the second embodiment has side protrusions 260 formed on a main body 240 instead of the wing parts of the first embodiment. A bottom surface 262 of each side protrusion 260 acts as the wing part of the first embodiment, and a re-projecting part 264 of each side protrusion 260 acts as the tab of the first embodiment. Excepting the above, the remaining structures are the same as in the first embodiment, so a detailed description will be omitted.

Figure 8A:
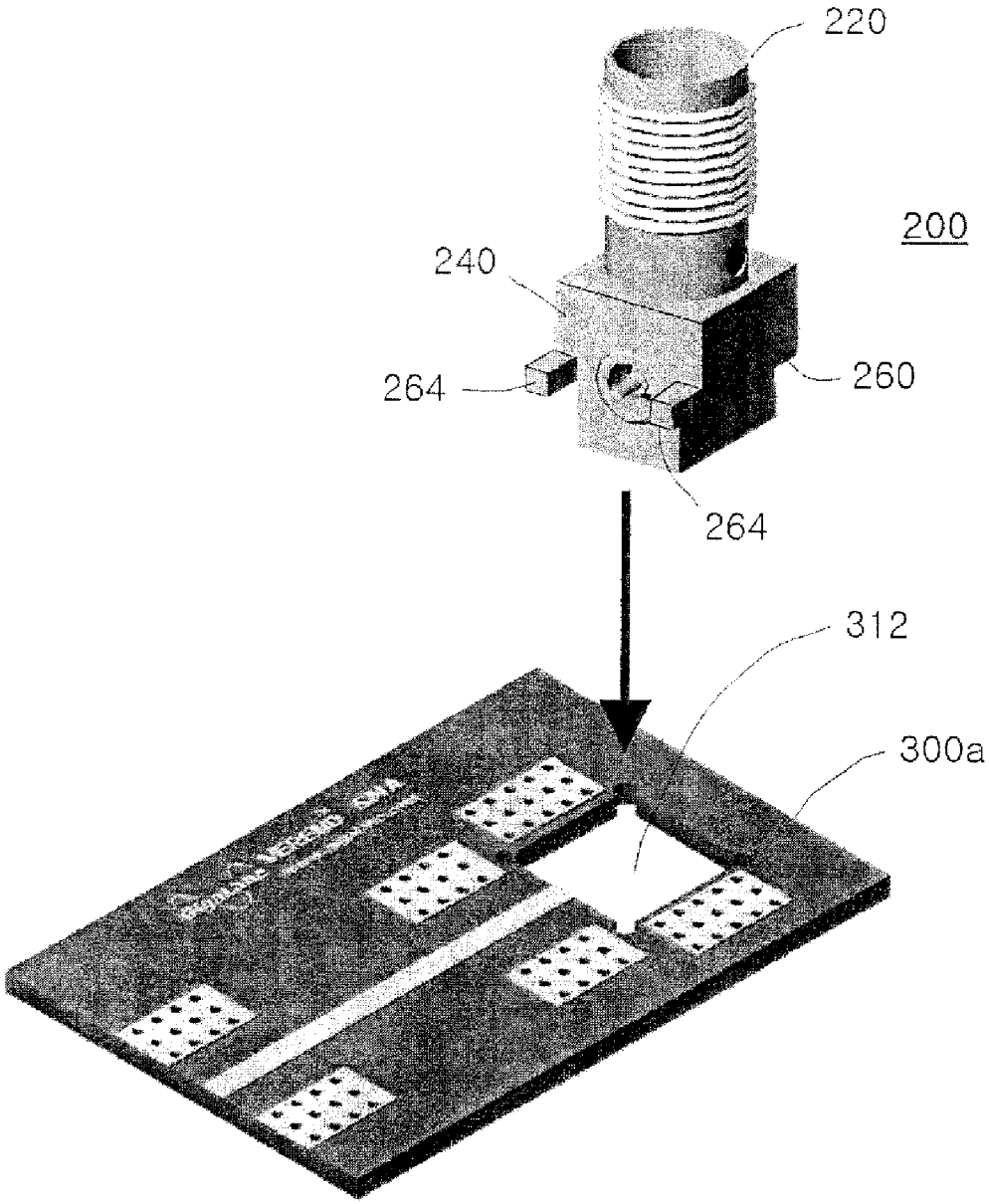
FIGS. 8*a* and 8*b* are perspective views showing a structure that the coaxial connector of the second embodiment is mounted on a board.
Figure 8B:
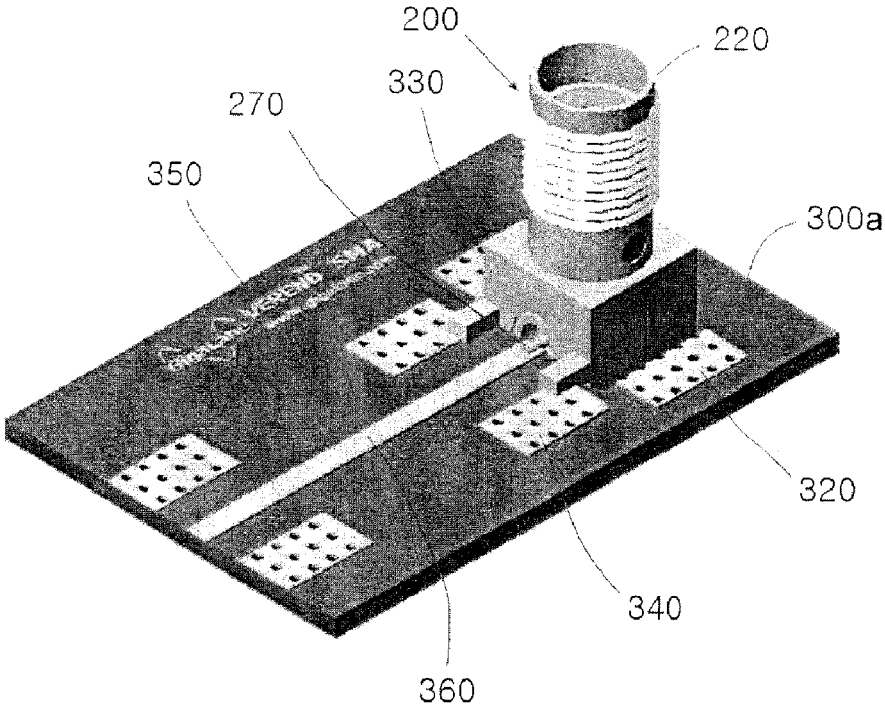
Figure 8C:
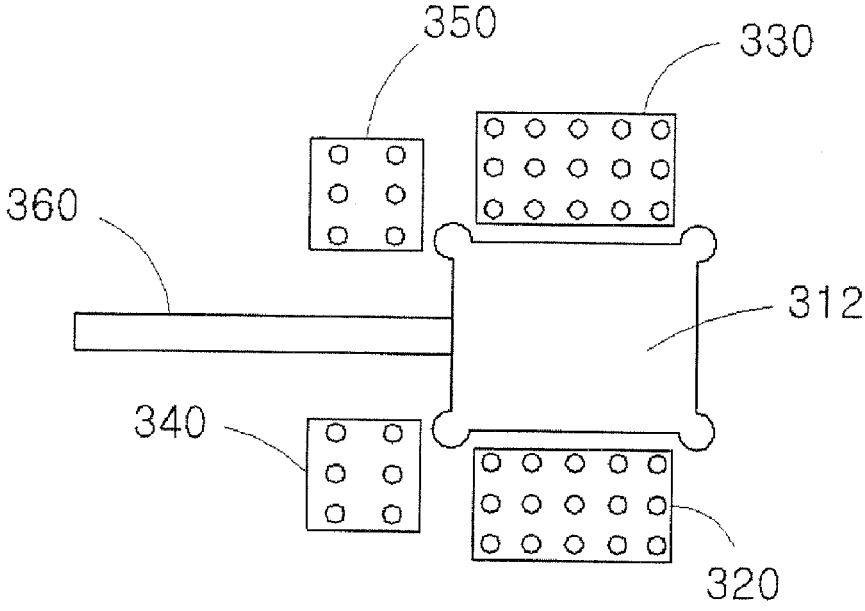
FIG. 8*c* is a pattern diagram of a board suitable for mounting of the coaxial connector of the present invention.

The coaxial connector 200, as shown in FIGS. 8*a* to 8*c*, is mounted to the PCB board 300*a* having a rectangular or square shaped through hole 312. In case of the coaxial connector 200 of this embodiment, the bottom surface 262 of each side protrusion 260 is joined by soldering to the side land patterns 320 and 330, and the re-projecting part 264 of each side protrusion 260 is joined by soldering to the front land patterns 340 and 350. Therefore, the bottom surfaces 262 and the re-projecting parts 264 act as ground supporters.

Figure 9:
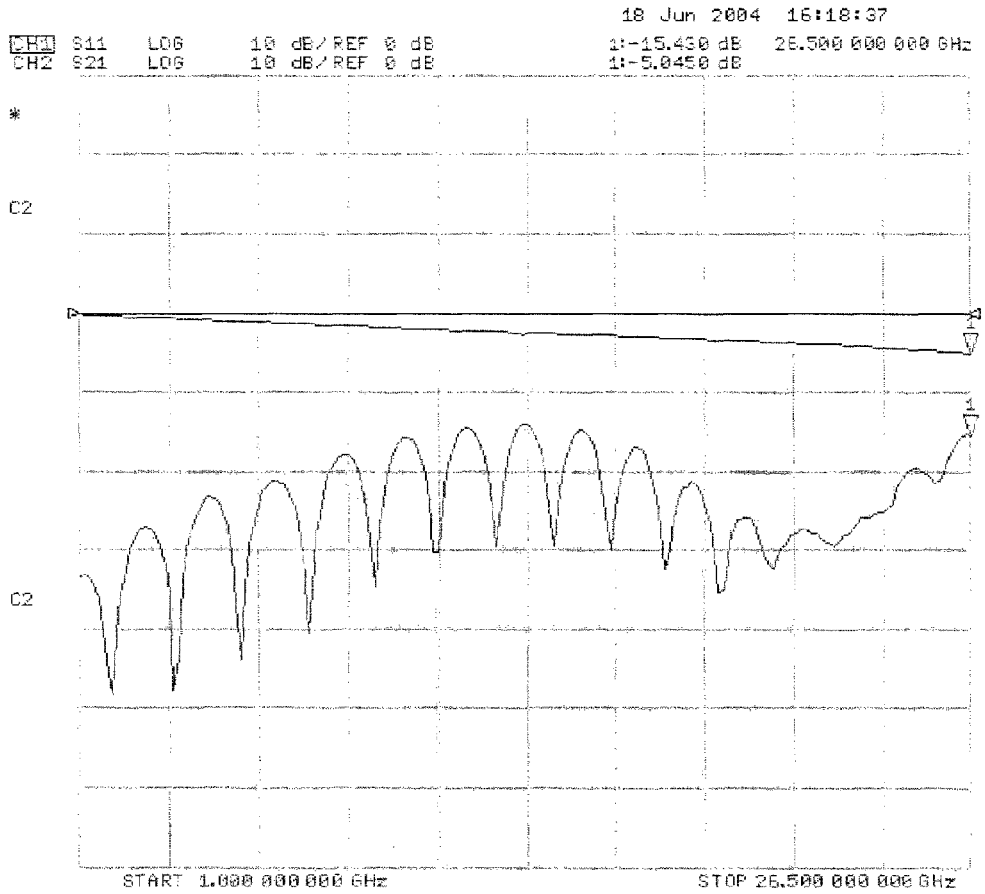
FIG. 9 is a graph showing electrical characteristics (return loss) of the coaxial connector of the present invention.

FIG. 9 is a graph showing electrical characteristics (return loss) of the coaxial connector of the present invention.

The measuring results shown in FIG. 9 were obtained by employing a PCB board having a thickness of 0.6 mm and made of FR4. In addition, the coaxial connectors according to the invention were connected to both ends of a transmission line with 50 ohm. In these measuring conditions, return loss of two connectors can be obtained simultaneously. The x-axis of the graph represents frequency ranging from 1 GHz to 26.5 GHz. The y-axis represents return loss. Generally, a good connector requires a return coefficient of about −15 dB. As shown in FIG. 9, the coaxial connector of the invention exhibits a return coefficient of −15 dB or less in a frequency range of 1~26.5 GHz.

INDUSTRIAL APPLICABILITY

The present invention can be effectively applied to high-frequency measuring equipment such as a measuring apparatus for semiconductor devices. Furthermore, the coaxial connector of the invention can be widely applied to space-limited systems due to a great number of input/output terminals.

The present invention can provide a coaxial connector having excellent electrical characteristics in spite of right angle structure. Moreover, the coaxial connector of the invention can be mounted onto the board by using insertion technique and surface-mounting technique. Additionally, a reflow soldering process can be used for mounting the coaxial connector of the invention on the board, so it is possible to allow mass production and automatic process.

What is claimed is:

1. A coaxial connector comprising:

a cylindrical body containing a dielectric therein;

a main body containing an air dielectric therein, being connected to the cylindrical body at a right angle to the cylindrical body;

a terminal conductor surrounded with the dielectric;

a central conductor surrounded with the air dielectric, being connected to the terminal conductor at a right angle to the terminal conductor, and being protruded from a front side of the main body;

a metal ring formed in close adjacent to the front side of the main body; and at least one ground supporter formed on the main body, being configured to support the main body in a way that a protruded portion of the central conductor is placed on a board in parallel with a surface of the board when the connector is mounted to a board, and to provide ground planes to the connector, wherein the main body includes an inner wall defining an opening therein, a first portion of the opening being adjacent to the cylindrical body and a second portion of the opening configured to be adjacent to the board, wherein the first portion of the opening is wider than the second portion of the opening, and wherein a portion of the central conductor adjacent to the terminal conductor has a greater diameter than a portion of the central conductor adjacent to the front side of the main body.

2. The coaxial connector of claim 1, further comprising:

a fixing member formed in the cylindrical body to fix the terminal conductor.

3. The coaxial connector of claim 1, wherein the ground supporter includes at least one wing part formed on and protruded from at least one side of the main body, and at least one tab formed on the front side of the main body and protruded from the main body.

4. The coaxial connector of claim 1, wherein the ground supporter includes at least one side protrusion formed on and protruded from at least one side of the main body, and at least one re-projecting part formed on the front side of the main body and protruded from the side protrusion.

5. The coaxial connector of claim 1, wherein a portion of the central conductor within the opening has a plurality of different diameters.

* * * * *